United States Patent [19]

Jentsch

[11] 4,234,996

[45] Nov. 25, 1980

[54] AUTOMATIC DOOR CLOSER CONSTRUCTED FOR RELEASABLY HOLDING A DOOR IN A PREDETERMINED PARTLY OPEN POSITION

[75] Inventor: Dietrich Jentsch, Ennepetal, Fed. Rep. of Germany

[73] Assignee: Dorma-Baubeschlag GmbH & Co. KG., Ennepetal, Fed. Rep. of Germany

[21] Appl. No.: 954,558

[22] Filed: Oct. 25, 1978

[30] Foreign Application Priority Data

Mar. 30, 1978 [DE] Fed. Rep. of Germany ..... 2813592

[51] Int. Cl.[2] ..... E05F 3/10; E05F 3/22

[52] U.S. Cl. ..... 16/52; 16/58; 16/62

[58] Field of Search ..... 16/52, 56, 58, 62, 64, 16/69, DIG. 9, DIG. 14

[56] References Cited

U.S. PATENT DOCUMENTS

| | | | |
|---|---|---|---|
| 3,079,629 | 3/1963 | Millard et al. | 16/52 |
| 3,546,734 | 12/1970 | Pollack et al. | 16/52 |
| 3,852,846 | 12/1974 | Slaybaugh | 16/62 X |
| 4,080,687 | 3/1978 | Jentsch | 16/52 |

FOREIGN PATENT DOCUMENTS

| | | | |
|---|---|---|---|
| 2541790 | 3/1977 | Fed. Rep. of Germany | 16/52 |
| 2311918 | 12/1976 | France | 16/52 |

*Primary Examiner*—Wm. Carter Reynolds
*Attorney, Agent, or Firm*—Michael J. Striker

[57] ABSTRACT

An automatic door closer constructed for releasably holding a door in a predetermined partly open position mainly comprises a piston arranged in a cylinder bore of a housing and operatively connected to a closer shaft mounted in the housing turnable about an axis substantially normal to that of the cylindrical bore so that the piston will be reciprocated in the bore during turning of a door connected to the closer shaft. The piston divides the bore in the housing in two compartments filled with fluid and a coil compression spring in one of the compartments biases the piston to an end position corresponding to the closed position of the door. The piston is provided with two passages therethrough, in one of which a one-way valve is arranged permitting flow of fluid only from the one compartment into the other during movement of the piston in door opening direction. The other passage is closed when the door reaches a predetermined partly open position preventing thereby fluid flow from the other compartment into the one compartment so that the door is held in this partly open position. The elements for closing the other passage comprise a valve member of a holding valve biased by a spring to a closed position so that the door may be moved in closing direction from the partly open position in which it is held only by application of an outer force applied thereto overcoming the biasing force of the spring acting on the valve member.

8 Claims, 6 Drawing Figures

78
69
51
83
53
32
33
48
30
73
75
16
11
18
66
66
60
62
61
64
64
63
63
81
77
80
68
82
50
76
79
72
71
70
23
10
20
22
74
31
47
16
17
66
18
25
26
27
64
24
21
63
12
65

VI
V
10
11
12
16
17
18
20
21
22
23
24
25
26
27
30
31
32
33
47
48
50
51
53
61
63
64
65
66
68
69
70
71
72
73
74
75
76
77
78
79
80
81
82
83

AUTOMATIC DOOR CLOSER CONSTRUCTED FOR RELEASABLY HOLDING A DOOR IN A PREDETERMINED PARTLY OPEN POSITION

BACKGROUND OF THE INVENTION

The present invention relates to an automatic door closer constructed for releasably holding a door in a predetermined partly open position. Such an automatic door closer is known in the art and this known automatic door closer includes a holding valve held in closed position by an electromagnet and cooperating with the other elements of the known automatic door closer so that the door will automatically close after opening the same through an angle smaller than a predetermined partly open position and so that the door is held in said predetermined partly open position and can be closed only when, through corresponding actuation of the electromagnet, the holding valve will be opened. Such door closers are preferably used at locations where in view of dangers, for instance a fire, the arrested door must be automatically released in case of such danger. Such automatically operable door closers connected to fire doors are therefore usually provided with a fire or smoke detector through which the electromagnet of the door closer may be actuated. The use of an automatic door closer provided with an electromagnet operable by a smoke detector is on normal doors rather expensive and uneconomical. At normal doors are therefore door closers used which move the door from any open position back to its closed position. If it is desired to hold the door provided with such an automatic door closer in any partly open position there is, besides the automatic door closer, a separate door arrester provided on the door. The known additional implements for arresting the door in any desired open position are usually constructed as clamping arresting means or as arm arresting means. Such additional arresting means cause not only considerable expenditures, but detrimentally influence also the appearance of the door.

SUMMARY OF THE INVENTION

It is an object of the present invention to provide an automatic door closer in which the door is automatically closed when partly opened, in which the door is releasably held in a predetermined partly open position from where it can be moved again to the closed position only by application of an outer force on the door in the direction for moving the same to the closed position.

It is a further object of the present invention to construct such a door closer from a few, relatively simple parts so that the door closer may be produced at very reasonable cost.

An additional object of the present invention is to provide a door closer having a pleasing appearance.

With these and other objects in view, which will become apparent as the description proceeds, the automatic door closer of the present invention mainly comprises an elongated housing provided with an axial cylindrical bore closed at opposite ends, a closer shaft adapted to be connected to a door and mounted in the housing intermediate the ends of the latter turnable about an axis extending transverse to that of said bore, piston means guided in the bore and dividing the latter into two compartments for a damping fluid, the piston means being operatively connected to the closer shaft and reciprocatable in the bore between a first end position in which a door connected to the closer shaft is fully closed, a predetermined intermediate position in which the door is partly opened and a second end position in which a door is fully opened, biasing means cooperating with the piston means for urging the same to the first end position, a first and a second passage extending through said piston means, a one-way valve in the first passage biased to permit flow of fluid from one of said compartments into the other of said compartments during movement of the piston means from the first towards the second end position and concomitant reduction of the volume of the one compartment while preventing flow of fluid in the opposite direction, and means for closing the second passage when the piston means reaches a predetermined intermediate position to thereby hold the piston means against the force of the biasing means in the intermediate position. The means for closing the second passage comprising a valve member normally held in closed position by a spring, the force of which may be overcome by applying an outer force to the door connected to the closer shaft to turn the latter in a direction to move said piston means from said predetermined intermediate position to said first end position.

In the construction according to the present invention an inexpensive spring is therefore used instead of an expensive electromagnet for holding the valve member in its closed position and thereby the piston means in the intermediate position in which the door connected to the closer shaft is held in a predetermined partly open position. By use of the spring for holding the valve member in the closed position in connection with other elements of the door closer the latter may be constructed from few and relatively simple parts to thus be producible at a reasonable cost. It is to be understood that the force of the spring holding the valve member in the closed position must be of a magnitude greater than the specific pressure of the hydraulic fluid produced by the biasing means acting on the piston means and urging the same to the first end position.

The spring for holding the aforementioned valve member normally in closed position is, according to an advantageous feature of the present invention, preferably constructed as a compression spring which abuts with opposite ends respectively on the aforementioned valve member and on one of the closed ends of the housing.

In order to adapt the force of the aforementioned spring to the pressure relationships in the door closer and in order to vary the closing force to be acted upon the door, an arrangement for adjusting the tension of the aforementioned spring preferably comprises a pin axially adjustably connected to the aforementioned closed end of the housing and the spring abuts with one end thereof against this axially adjustable pin. This adjusting pin is preferably accessible from the outside of the housing, threadingly connected and properly sealed to the latter in order to avoid that hydraulic fluid may penetrate to the outside of the housing.

The biasing means for biasing the piston means to its first end position, in which the door connected to the closer shaft is fully closed, is preferably constituted by a coil compression spring arranged in the housing bore and a space saving, the axial length of the door closer shortening, construction will result from a further feature according to the present invention in that the aforementioned valve member and the elements mounting the same are arranged within the confines of the aforementioned coil compression spring.

The above-mentioned piston means preferably comprise a first piston head abutting in the mentioned one end position of the piston means against the other of the closed ends of the housing and a second piston head axially spaced from and connected to the first piston head for simultaneous reciprocation. An advantageous construction which reduces the necessary material and fabricating cost of the door closure is obtained in that the second piston head is provided with the first and second above-mentioned passages therethrough, wherein the second passage is constituted by a bushing and wherein the means for closing the second passage comprises a stationary tubular means coaxially arranged with the bushing and having a free end spaced from the bushing in the first end position of the piston means and sealingly entering the bushing upon movement of the piston means to the predetermined intermediate position. The aforementioned tubular means preferably comprises a tube engageable with one end thereof into the bushing, a tubular member connected to the other end of the tube and being formed with a valve seat engageable by the aforementioned valve member and with a transverse bore communicating with the one compartment and a sleeve connecting the tubular member to the one closed end of the housing and also provided with a transverse bore, wherein the spring biasing the valve member to the closed position is located in this sleeve.

The sleeve is sealingly arranged with an end portion thereof in a bore through the one closed end of the housing, coaxial with the cylindrical bore formed in the latter, and the end portion of the sleeve is provided with an inner screw thread into which the aforementioned axial adjustable pin is screwed against which one end of the spring biasing the valve member to the closed position abuts, to thus adjust the force of the spring.

The second piston head preferably comprises a portion preferably integrally connected to the first piston head and being formed with a central recess and a stepped disk is located in this recess. The aforementioned bushing engages with the shoulder thereof the stepped disk and is screwed into the aforementioned portion of the second piston head so as to hold the stepped disk in the recess. The one-way valve is located in a passage in the stepped disk communicating with the first passage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2, 6:
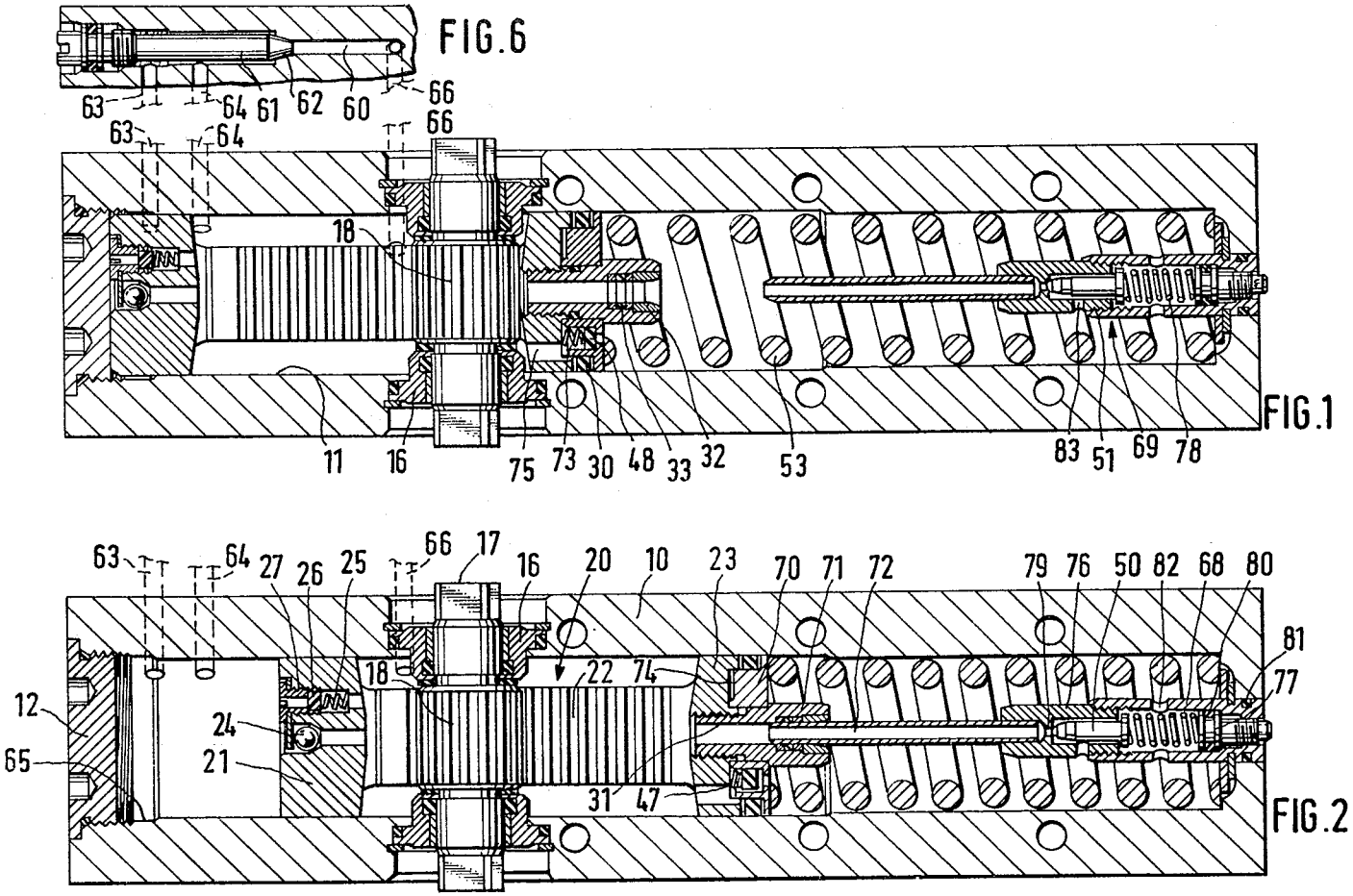
FIG. 1 is a longitudinal cross section through the door closer according to the present invention and showing the piston means in a first end position corresponding to a fully closed position of the door connected thereto.
FIG. 2 is an axial cross section through the door closer shown in FIG. 1 with the piston means moved in door opening direction.
FIG. 6 is a partial axial cross section according to the line VI—VI of FIG. 5.

Referring now to the drawing, it will be seen the the door closer according to the present invention comprises an elongated housing 10 of square cross section provided with an axial cylindrical bore 11. The bore 11 is at its left end, as viewed in FIG. 1, fluid-tightly closed by a plug 12, whereas a sleeve 68 is arranged in a bore at the right closed end of the housing which receives a holding valve 69. The aforementioned sleeve is arranged properly sealed in the aforementioned bore through the closed end of the housing. Two bores aligned along an axis transverse to the axis of the cylindrical bore 11 are provided in the housing 10 to receive the bearings 16 of a closer shaft 17, which is provided at its central region between the bearings with a pinion 18 fixedly connected thereto. The bearings 16 are properly sealed toward the closer shaft 17 and the housing 10. The closer shaft 17 has preferably square end portions projecting beyond the bearings 16 for connecting thereto a non-illustrated lever arm, which in turn is to be connected to a likewise non-illustrated door to be closed by the door closer. The aforementioned level arm may therefore be, according to the installation of the door closer, connected to the one or the other end of the closer shaft 17 for turning therewith.

Piston means 20 are reciprocatably arranged in the cylindrical bore 11 and the piston means 20 comprise a first piston head 21 connected by a web 22 to a second piston head 23. The connecting web 22 is constructed as a rack which meshes with the pinion 18. A turning movement of the closer shaft 17 will result therefore in a longitudinal movement of the piston means 20. A one-way valve 24 constituted by a stepped bore forming a valve seat and a ball adapted to engage this valve seat is arranged in the first piston head 21 and this one-way valve 24 is adapted to open towards the space of the cylinder bore 11 to the left side of the piston head 21. An overpressure valve constituted by a valve member 26 biased by spring 25 to abut against a valve seat in a sleeve 27 screwed into another bore through the first piston head 21 is arranged laterally of the one-way valve 24. The overpressure valve 25–27 opens if in the space to the left side of the piston head 21, as viewed in FIG. 1, a predetermined overpressure with respect to the pressure to the right side of the piston head 21 exists in the bore 11.

The portion of the second piston head 23 which is integrally connected to the web 22 is formed at the right side thereof, as viewed in the drawing, with a central recess in which a stepped disk 70 is arranged forming with the aforementioned portion of the second piston head an annular groove in which an annular sealing ring 30 is arranged. The stepped disk 70 is held in the aforementioned recess by a bushing 71 which is screwed into the aforementioned portion of the second piston head 23 and which engages with a shoulder the stepped disk 70. The bushing 71 is provided with a central stepped bore 31 in which an elastic annual seal 33, held by a ring 32, is arranged. A tube 72 is fixedly connected to the holding valve 69 coaxial with the stepped bore 31 in the bushing 71. The free end of the tube 72 is spaced from the outer end of the bushing 71, when the first piston head 21 abuts against the plug 12, as shown in FIG. 1. Whereas the outer diameter of the tube 70 is constructed to sealingly engage the annular seal 33, the free end of the tube 72 is preferably chamfered to facilitate entrance thereof into the annular seal 33 in the bushing 71 in the second piston head 23. For the same reason the ring 32 holding the annular seal 33 in the bushing 71 is also provided at its outer end with a conical bore tapering towards the second piston head 23. The stepped disk 70 connected with the piston head 23 is further provided with a bore or passage 73, parallel to the stepped bore 31, and in which a valve member 48 is arranged, which is biased by a spring 47 against a step or shoulder in the bore 73. The recess in the piston head 23 forms together with the step in the stepped disk 70 a closed annular space 74 with which a bore 75 through the piston head 23 communicates.

The holding valve 69 comprises the sleeve 68 connected to the bottom of the housing 10, a tubular member 76 holding the tube 72 and screwed into the sleeve 68, a valve member 50 arranged in the tubular member 76 and an adjusting pin 77, with a compression spring 78 arranged between the valve member 50 and the adjusting pin 77. The valve member 50 is bolt-shaped and guided with its cylindrical portion 51 in the tubular member 76 for movement in axial direction. The frustoconical end of the valve member 50 is normally pressed by the force of the spring 78 onto a valve seat 79 formed in the tubular member 76, and the tension of the compression spring 78 may be adjusted by the pin 77 screwed into the sleeve 68. The interior of the housing 10 is sealed toward the outside, on the one hand, by a sealing ring 80 surrounding the head of the adjusting pin 77 and, on the other hand, by a sealing ring 81 arranged in an annular groove of the portion of the sleeve 68 which passes through a bore in the bottom of the housing 10. The sleeve 68 as well as the tubular member 76 are each provided with at least one transverse bore 82, respectively 83 by means of which the interior of the sleeve 68 and the tubular member 76 communicate with the space surrounding the aforementioned members in the bore 11 of the housing 10.

Figures 3, 4, 5:
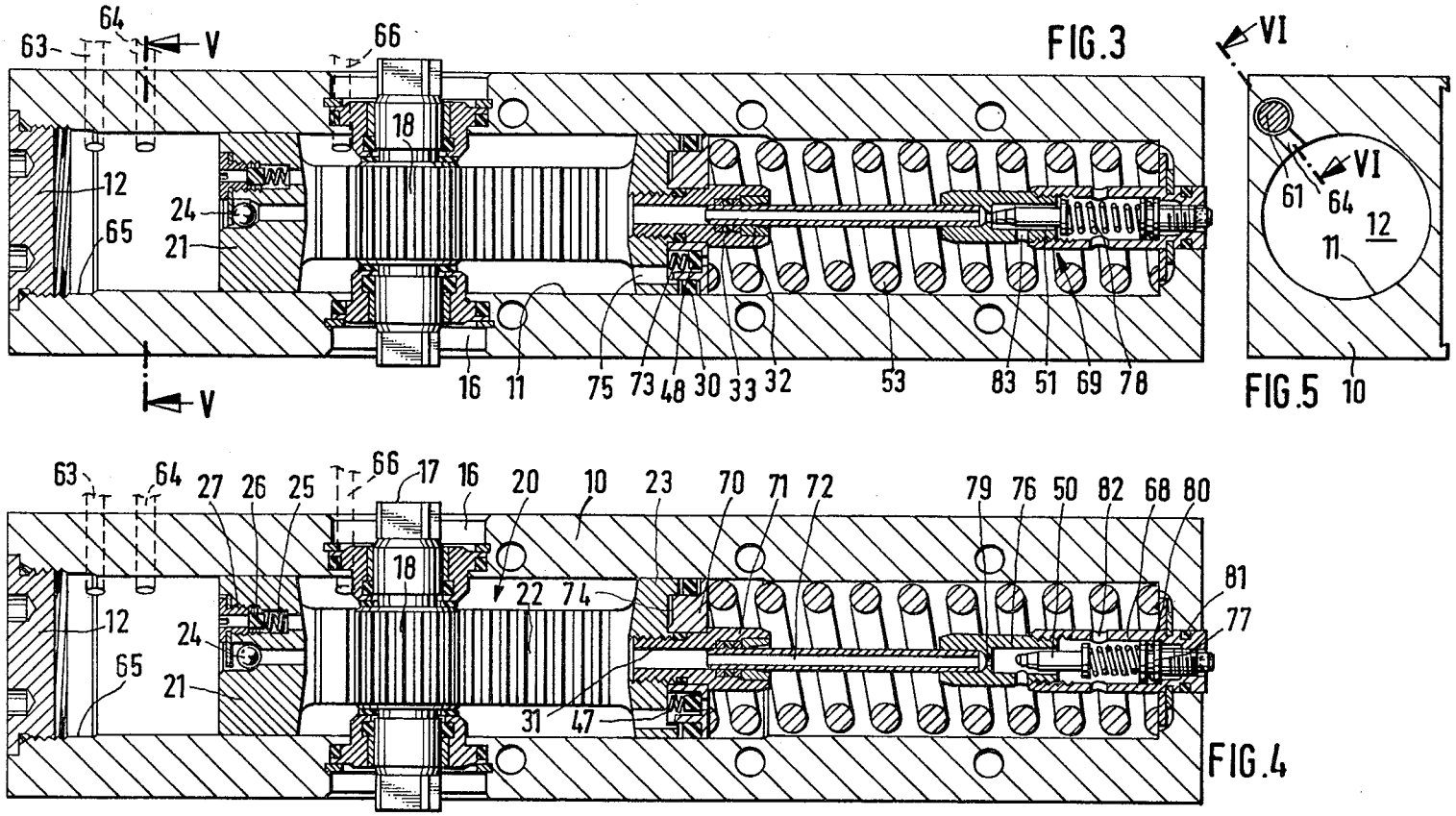
FIG. 3 is an axial cross section through the door closer shown in FIG. 1 with the piston means shown in a position which corresponds to the position at which the door has been turned to a predetermined partly open position in which it is stationarily held.
FIG. 4 is an axial cross section through the door closer of FIG. 1 and showing the various elements thereof in a position in which the arrested door is released so that it may be returned to the closed position.
FIG. 5 is a transverse cross section according to the line V—V of FIG. 3.

As seen in FIGS. 5 and 6 the housing 10 is further provided with a stepped bore 60 into the left end of which, as viewed in FIG. 6 a throttle cone is screwed to form a throttle valve 61. The conical head of the throttle valve 61 is designated with the reference numeral 62. As shown in FIG. 6, two transverse bores 63 and 64 lead from the cylinder bore 11 of the housing into the annular space in the bore 60 around the portion of the valve cone to the left side of its head 62. The bore 63 ends at an enlarged end region 65 of the cylinder bore 11, whereas the inner end of the bore 64 may be closed by the piston head 21. A further transverse bore 66 leads from the right end of the bore 60, as viewed in FIG. 6, to the region of the cylinder bore 11 occupied by the web 22, which bore 66 cannot be covered by either of the cylinder heads. It is to be understood that the cylindrical bore 11 and the bores and channels communicating therewith are filled with hydraulic fluid.

The above-described door closer will operate as follows:

The various elements of the door closer are illustrated in FIG. 1 in a position corresponding to a closed position of the door connected thereto. If the door is now turned in opening direction, the closer shaft 17 is turned therewith by the non-illustrated lever arm in a known manner. Thereby the pinion 18 on the closure shaft 17 will move the piston means 20 toward the right, as viewed in FIG. 1, whereby the volume of the space to the left side of the piston head 21 is increased, whereas the volume of the space to the right of the piston head 23, in which the coil spring 53 is arranged, is correspondingly decreased. Therefore, liquid will flow first through the stepped bore 31 in the piston head 23 into the region of the cylinder bore 11 in which the web 22 is arranged and further through the one-way valve 24 to the portion of the cylinder bore 11 at the left side of the piston head 21. This flow will continue until the free tapered end of the tube 72 sealingly engages into the annular seal 33 in the bushing 71 (FIG. 2). Therewith the above-mentioned passage for the liquid from the space on the right side of the piston head 23 through the bore 31 to the space to the left side of the piston head 21 is blocked. Nevertheless, the piston means can be further moved against the tension of the coil spring 53 towards the right, while the tube 72 penetrates further into the bore 31, that is the door can be opened wider, since from the space at the right side of the piston head 23 liquid may be passed through the one-way valve 47, 48 into the region of the cylindrical bore 11 located to the left side of the piston head 23 from which the liquid may again flow through the one-way valve 24 into the space to the left side of the piston head 21. The door may therefore be fully opened without any liquid passing through the throttle 61, 62 or past the valve member 50.

If the door opening movement, through which the spring 53 biasing the piston means 20 is tensioned, is stopped, before the free end of the tube 72 enters into the annular seal 33, the open door will be automatically closed by the tensioned coil spring 53. The piston means 20 moves thereby toward the left and liquid can pass from the portion of the cylindrical bore 11 to the left side of the piston head 21 through the bores 63 and 64 over the throttle 61, 62 into the bore 60 and from there through the transverse bore 66 into the space of the cylinder bore 11 occupied by the web 22 and from this space through the stepped bore 31 of the bushing 71 in the piston head 23 to the space of the cylindrical bore 11 which is occupied by the coil spring 53. If the movement of the door in closing direction is produced not only by the coil spring 53 acting on the piston means 20, but in addition thereto also by an outer force, it is still not possible that the pressure of the liquid in the space to the left of the piston head 21 may increase in an undesirable manner since if a predetermined pressure is reached in this space the safety valve 25–27 will open so that the liquid may pass directly from the space at the left side of the piston head 21 to the space at the right side thereof.

If the opening movement of the door is only finished after the free end of the tube 72 has already entered into the annular seal 33 so that liquid cannot any longer flow freely into the space of the cylindrical bore 11 occupied by the coil spring 53, then the further function of the door closure will be determined by the elements 50, 76, 78 of the holding valve 69. If the valve member 50 of the holding valve 69 is held by the compression spring 78 in the closed position, then liquid cannot flow out any longer from the space of the cylinder bore 11 located at the left side of the piston head 23 through the tube 72 and the transverse bore 83, since such flow is interrupted by the engagement of the valve member 50 with the valve seat 79. The door is therefore being held in a predetermined partly open position.

If now in this position of the door an outer force will be applied thereto in door closing direction, this will produce in the space located to the left side of the piston head 23 a sufficient high fluid pressure which will act through the tube 72 onto the left end of the valve member 50 to move the latter against the pressure of the spring 78 out of engagement with the valve seat 79 so that liquid may pass through the transverse bore 83 to the space to the right side of the piston means 20. The door may therefore be closed from the open position by a sufficiently large force acting thereon in closing direction. The necessary force which has to be applied to the door to close the latter is adjustable within limits by adjusting the tension of the compression spring 78 acting on the valve member 50 by means of the adjusting pin 77, which can be operated from the outside to be moved in axial direction by an appropriate socket applied to the outer end of the adjusting pin. By the last-mentioned closing movement of the door, the liquid located to the left side of the piston head 21 may also pass through the overpressure valve 25–27 in the event flow of liquid through the bore 60 is throttled too much by the throttle 61, 62.

It is further mentioned that the side-by-side arrangement of the two transverse bores 63 and 64 in connection with the enlarged end portion 65 of the cylinder bore 11 has the purpose to bypass the throttle 61, 62 during the last part of the closing movement of the door, in that the liquid in the space to the left side of the piston head 22 may flow without throttling into the space to the right side of the piston head 21 and further through the step bore 31 into the space to the right side of the piston head 23 so that the door latch may properly engage.

It will be understood that each of the elements described above, or two or more together, may also find a useful application in other types of automatic door closers differing from the types described above.

While the invention has been illustrated and described as embodied in an automatic door closer constructed for releasably holding a door in a predetermined partly opened position, it is not intended to be limited to the details shown, since various modifications and structural changes may be made without departing in any way from the spirit of the present invention.

For instance it is possible to replace the compression spring 78 by a gas pillow arranged in an elastically compressible casing.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an automatic door closer, a combination comprising, an elongated housing provided with an axial cylindrical bore closed at opposite ends; a closer shaft adapted to be connected to a door and mounted in said housing intermediate the ends of the latter turnable about an axis extending transverse to the axis of said bore; piston means guided in said bore and dividing the bore into two compartments for a damping fluid, said piston means being operatively connected to said closer shaft and reciprocatable in said bore between a first end position in which a door connected to the closer shaft is fully closed, a predetermined intermediate position in which the door is partly opened, and a second end position in which the door is fully opened; biasing means cooperating with the piston means for urging the same to said first end position, said biasing means comprising a coil compression spring in one of said compartments abutting with opposite ends against said piston means and one of said closed ends of said housing; a first and a second passage extending through said piston means; a one-way valve in said first passage biased to permit flow of fluid in one direction from said one compartment into the other of said compartments during movement of said piston means from said first towards said second end position and concomitant reduction of the volume of said one compartment while preventing flow of fluid in the opposite direction; and means for closing said second passage when said piston means reaches said predetermined intermediate position to thereby hold said piston means against the force of said biasing means in said intermediate position, said means for closing said second passage comprising a valve member and a compression spring abutting with opposite ends respectively against said valve member and said one closed end of said housing and normally holding said valve member in closed position, the force of said compression spring may be overcome by applying an outer force to the door connected to said closer shaft to turn the latter in a direction to move said piston means from said predetermined intermediate position to said first end position, said means for closing said second passage including said valve member being located within said coil compression spring.

2. In an automatic door closer, a combination comprising, an elongated housing provided with an axial bore closed at opposite ends; a closer shaft adapted to be connected to a door and mounted in said housing intermediate the ends of the latter turnable about an axis extending transverse to the axis of said bore; piston means guided in said bore and dividing the bore into two compartments for a damping fluid, said piston means being operatively connected to said closer shaft and reciprocatable in said bore between a first end position in which a door connected to the closer shaft is fully closed, a predetermined intermediate position in which the door is partly opened, and a second end position in which the door is fully opened; biasing means cooperating with said piston means for urging the same to said first end position, said biasing means comprising a coil compression spring in one of said compartments abutting with opposite ends respectively against said valve member and one of said closed ends of said housing, said piston means comprising a first piston head abutting in said one end position of said piston means against the other of said closed ends of said housing and a second piston head axially spaced from and connected to said first piston head for a simultaneous reciprocation; a first passage extending through said second piston head; a one-way valve in said first passage biased to permit flow of fluid in one direction from said one compartment into the other of said compartment during movement of said piston means from said first towards said second end position and concomitant reduction of said one compartment while preventing flow of fluid in the opposite direction; a second passage constituted by a bushing also extending through said second piston head; and means for closing said second passage when said piston means reaches said predetermined intermediate position to thereby hold said piston means against the force of said biasing means in said intermediate position, said means for closing said second passage comprising a valve member, a compression spring abutting with opposite ends respectively against said valve member and said one closed end of said housing, and stationary tubular means coaxially arranged with said bushing and having a free end spaced from said bushing in said first end position of said piston means and sealingly entering into said bushing upon movement of said piston means to said predetermined intermediate position, said valve member preventing in said closed position passage of fluid through said tubular means, the force of said spring holding said valve member in said closed position may be overcome by applying an outer force to the door connected to said closer shaft to turn the latter in a direction to move said piston means from said predetermined intermediate position to said first end position.

3. A combination as defined in claim 2, wherein said tubular means comprises a tube engageable with one end thereof into said bushing, a tubular member connected to the other end of said tube and being formed with a valve seat engageable by said valve member and with a transverse bore communicating with said one compartment and a sleeve connecting said tubular member to said one closed end of said housing and also provided with a transverse bore, said spring biasing said valve member to said closed position being located in said sleeve.

4. A combination as defined in claim 3, wherein said sleeve is sealingly arranged with an end portion thereof in a bore through said one closed end of said housing coaxial with said cylindrical bore, said end portion of said sleeve being provided with an inner screw thread into which an axially adjustable pin is screwed against which one end of the spring biasing said valve member to said closed position abuts, to thus permit adjustment of the tension of said spring.

5. A combination as defined in claim 2, wherein said second piston head comprises a portion connected with said first piston head and being formed with a central recess, a stepped disk located in said recess, said bushing engaging with a shoulder thereof said stepped disk and being screwed into said portion so as to hold said stepped disk in said recess, said one-way valve being located in a passage through said stepped disk communicating with said first passage.

6. A combination as defined in claim 3, wherein said first and said second piston head are connected to each other by a rack, and including a pinion meshing with said rack and coaxially fixed to said closer shaft.

7. A combination as defined in claim 2, wherein said first piston head is provided with two bores therethrough, and including a one-way valve in one of said bores and an overpressure valve in the other of said bores.

8. A combination as defined in claim 2 and including a passage through the wall of said housing communicating at one end with said other compartment and at the other end with the space in the cylindrical bore through the housing between said piston heads and a throttle valve in said passage.

* * * * *